United States Patent [19]

Shibukawa

[11] Patent Number: 4,628,788

[45] Date of Patent: Dec. 16, 1986

[54] AUTOMATIC RHYTHM PERFORMING APPARATUS

[75] Inventor: Takeo Shibukawa, Hamamatsu, Japan

[73] Assignee: Nippon Gakki Seizo Kabushiki Kaisha, Hamamatsu, Japan

[21] Appl. No.: 693,689

[22] Filed: Jan. 23, 1985

[30] Foreign Application Priority Data

Jan. 28, 1984 [JP] Japan ..... 59-10585[U]
Jan. 28, 1984 [JP] Japan ..... 59-10586[U]
Jan. 28, 1984 [JP] Japan ..... 59-10587[U]

[51] Int. Cl.[4] ..... G10F 1/00
[52] U.S. Cl. ..... 84/1.03; 84/DIG. 12
[58] Field of Search ..... 84/1.03, DIG. 12

[56] References Cited

U.S. PATENT DOCUMENTS 4,357,854 11/1982 Hirano ..... 84/1.03
4,412,471 11/1983 Stier et al. ..... 84/1.03
4,467,690 8/1984 Nishimoto ..... 84/1.03
4,487,098 12/1984 Mishima ..... 84/1.03
4,534,257 8/1985 Mitarai ..... 84/DIG. 12

*Primary Examiner*—Russell E. Adams
*Attorney, Agent, or Firm*—Spensley Horn Jubas & Lubitz

[57] ABSTRACT

An automatic rhythm performing apparatus comprises a rhythm pattern generator (A); a rhythm tone generator; a rhythm control switch (B); and a control circuitry (C) connected to the rhythm pattern generator, the rhythm tone generator and the rhythm control switch. The rhythm pattern generator generates repetitively a repetition period signal defining a repetition period, a first (normal) rhythm pattern signal with the period, and a second (fill-in) rhythm pattern signal with the period. The rhythm tone generator generates rhythm tone signals in response to said first and second rhythm pattern signals. The control means controls the generation of the rhythm tone signals to be responsive to which of the first and second rhythm pattern signals according to timings of the actuation of the rhythm control switch. Thus the apparatus carries out a variety of rhythm control according to the timings of the actuation of the rhythm control switch.

8 Claims, 2 Drawing Figures

AUTOMATIC RHYTHM PERFORMING APPARATUS

BACKGROUND OF THE INVENTION a. Field of the Invention:

This invention relates to an automatic rhythm performing apparatus automatically generating rhythm tone signals according to rhythm patterns.

b. Description of the Prior Art:

In a known rhythm performing apparatus, when rhythm tone sounds are being generated according to a normal pattern of such particular type of rhythm as, for example, swing, disco, waltz, ballad or tango, if a rhythm fill-in switch is turned on, then the rhythm pattern of the generated rhythm tone sounds will be changed from the normal pattern to a fill-in pattern to vary the rhythm tone sounds. However, in such a conventional apparatus, the rhythm pattern of rhythm tone sounds will be automatically returned to the normal pattern from the fill-in pattern at the end of the measure in which the fill-in switch has been turned on, and therefore the user can designate only the beginning timing of the fill-in rhythm by the fill-in pattern and consequently the user has little space to be able to reflect his own intention on the automatic rhythm performance. This has been the same also with respect to a break of the rhythm which is a temporary interruption of the rhythm tone sounds by turning on a rhythm break switch. Also, at the moment of the return to the normal pattern of the rhythm tone sounds, the user will hardly follow the rhythm tone sounds continuously. Further, as the obtained rhythm variation is made only by the mere pattern switching, the rhythm performance will be likely to be with poor variety. There have been such defects as in the above.

SUMMARY OF THE INVENTION

A primary object of the present invention is to provide an automatic rhythm performing apparatus wherein the above described disadvantages are eliminated and such rhythm control as the fill-in or break of the rhythm is carried out in different manners in response to the timewise actuation mode of switches so that a complicated rhythm control may be made with few switches, and thus various rhythm performances may be possible.

This object is attained by an automatic rhythm performing apparatus comprising:

a rhythm pattern generator for repetitively generating (i) a repetition period signal defining a repetition period, (ii) a first rhythm pattern signal representing kinds and timings for rhythm tones to constitute a first rhythm pattern with said period, and (iii) a second rhythm pattern signal representing kinds and timings for rhythm tones to constitute a second rhythm pattern with said period;

a rhythm tone generator for generating rhythm tone signals of said kinds and timings in response to said first and second rhythm pattern signals;

a rhythm control switch; and control means connected to said rhythm pattern generator, said rhythm tone generator and said rhythm control switch for controlling the generation of said rhythm tone signals to be responsive to which of said first and second rhythm pattern signals according to the actuation manner of said rhythm control switch.

Preferably, the present apparatus is so formed that said control means controls the generation of said rhythm tone signals so that said rhythm tone signals correspond to said first rhythm pattern signal in a normal state and to said second rhythm pattern signal in a temporary state according to the actuation of said rhythm control switch.

More preferably, the present apparatus is so formed that said control means controls differently the generation of said rhythm tone signals according to difference in actuation timings of said rhythm control switch with respect to said period and is so formed more preferably that said control means controls in two different manners so that said temporary state is maintained until the end of said period in which the actuation of said rhythm control switch is released in a first manner whereas said temporary state is maintained until a further actuation of said rhythm control switch is carried out within said period in which the actuation of said rhythm control switch is released in a second manner.

According to the present invention, as such rhythm control as the fill-in or break of the rhythm is made in different manners in response to the timewise actuation mode of a switch, a complicated rhythm control can be attained with few rhythm control switches, at the same time, it is easy to reflect the intention of the user on the automatic rhythm performance and thus various rhythm performances are possible.

More advantageously, the present apparatus is so formed that said control means controls the generation of said rhythm tone signals so that said rhythm tone signals correspond to said first rhythm pattern signal in a normal state and to said first and second rhythm pattern signals in a temporary state according to the actuation of said rhythm control switch.

According to this embodiment, as rhythm tone signals corresponding to the first and second rhythm pattern signals are generated according to the actuation of the rhythm control switch, a combined rhythm tone signal by the first and second rhythm pattern signals will be obtained and thus, by the compound performance effect by the two rhythm patterns, further various rhythm performances will be possible.

More advantageously, the present apparatus is so formed that said control means so controls that a rhythm tone signal of a particular kind is generated at a moment subsequent to a period where said rhythm tone signals correspond to the temporary rhythm pattern signals.

According to this embodiment, after the repetition period of a rhythm performance in a temporary state ends, for example, a rhythm tone signal of a particular type will be generated as synchronized with the top beat of the next repetition period, therefore, in the case of the return to the normal state, rhythm tone sounds of such particular percussion instrument as, for example, cymbals will be obtained. Thus, the user will easily follow the rhythm and various rhythm performances will be possible.

This and other objects of the present invention will become more apparent during the course of the following detailed description and appended claims.

DESCRIPTION OF THE PREFERRED EMBODIMENT

Figure 1:
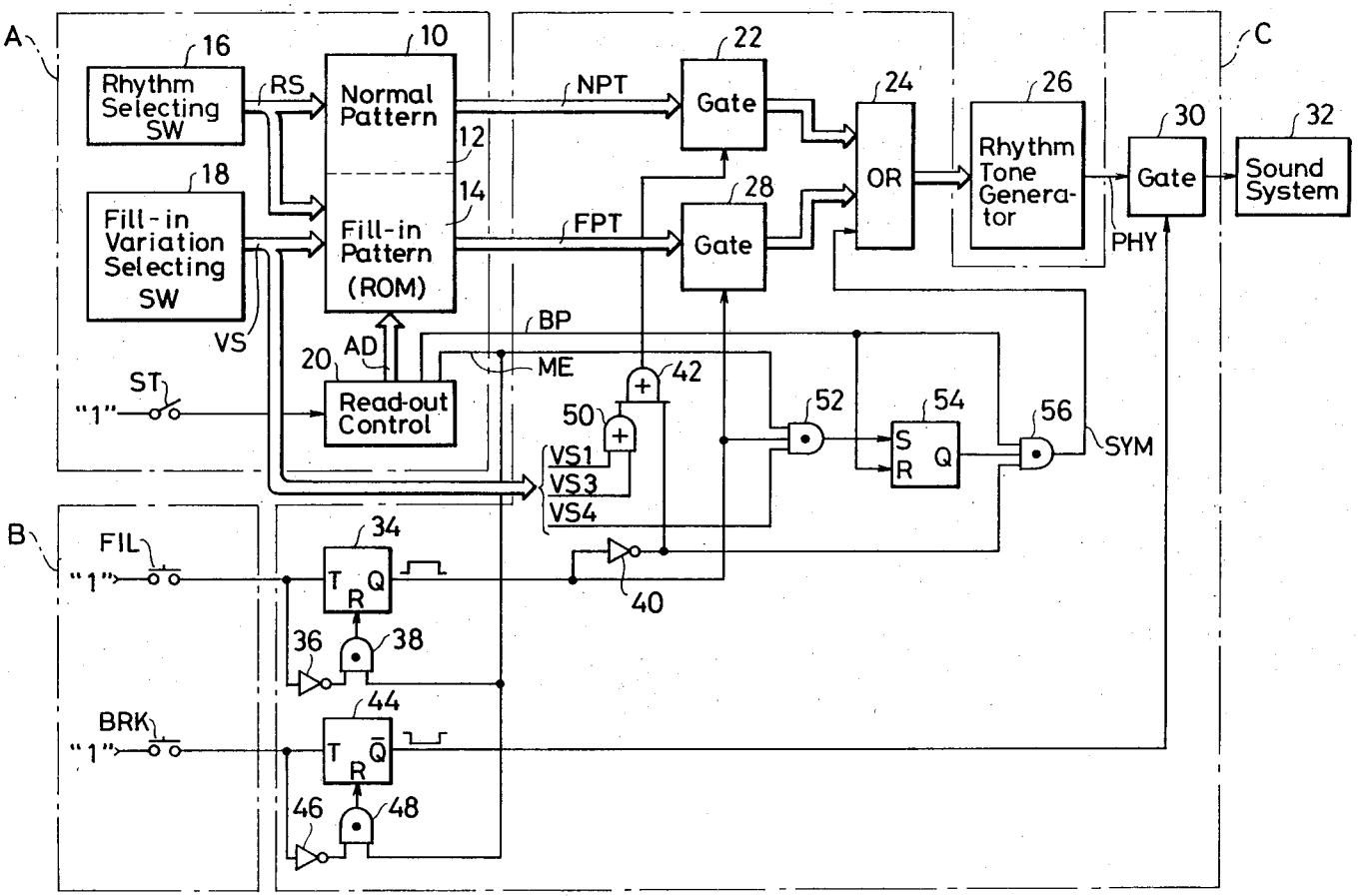
FIG. 1 is a block diagram showing an embodiment of an automatic rhythm performing apparatus according to the present invention.

FIG. 1 shows an embodiment of the automatic rhythm performing apparatus according to the present invention.

A rhythm pattern generating circuit 10 consists of a ROM (read only memory) memorizing various rhythm pattern data etc., and includes a normal pattern generating part 12 and a fill-in pattern generating part 14. The normal pattern generating part 12 memorizes data for normal rhythm pattern corresponding respectively to such many types (kinds) of rhythms as swing, disco, waltz, ballad and tango, and the fill-in pattern generating part 14 memorizes data for each four types of fill-in rhythm patterns for each of the groups in case the above mentioned many types of rhythms are classified into a plurality of groups of similar rhythms (for example, a group of the disco music family and a group of the Latin music family etc.). A rhythm selecting switch (SW) circuit 16 includes a rhythm selecting switch for selecting a type of rhythm desired to be performed from among the above described many types of rhythms and is to feed a rhythm-type designating signal which designates the selected type of rhythm to the normal pattern generating part 12 and the fill-in pattern generating part 14. A fill-in variation selecting switch (SW) circuit 18 includes a variation selecting switch for selecting any of the first to fourth fill-in variations corresponding respectively to the above described four types of fill-in rhythm pattern data and is to feed a fill-in variation designating signal VS which designates the selected fill-in variation to the fill-in pattern generating part 14. A read-out control circuit 20 includes tempoclock generator, counter, etc. so that, when a rhythm start switch ST is turned on, it will feed an address signal AD to the rhythm pattern generating circuit 10 for reading out the pattern data. A measure end pulse ME sinchronized with the measure end timing for each measure (or each predetermined rhythm pattern repetition period), and a top beat pulse BP synchronized with the top beat (first down beat) for each measure (or the pattern period) will be fed of the read-out control circuit 20. A rhythm pattern generator A is formed of the above mentioned rhythm pattern generating circuit 10, rhythm selecting switch circuit 16, fill-in variation selecting switch circuit 18 and read-out control circuit 20.

The normal pattern generating part 12 is to deliver a normal pattern signal NPT of the particular type of rhythm, as the normal pattern data corresponding to the particular type of rhythm designated by the rhythm-type designating signal RS are read out in response to the address signal AD. This normal pattern signal NPT includes signals for driving such various rhythm tone generators as a bass drum, snare drum, conga, maracas and cymbals, etc. so as to be fed to a rhythm tone generator circuit 26 through a gate circuit 22 and an OR-circuit 24 when the gate circuit 22 is controlled to be on (i.e. rendered conductive).

The fill-in pattern generating part 14 is to deliver a fill-in pattern signal FPT of the particular fill-in variation, as the particular fill-in pattern data which are designated by both the rhythm-type designating signal RS and the fill-in variation designating signal VS are read out in response to the address signal AD. The same as the above described normal pattern signal NPT, this fill-in pattern signal FPT also includes signals for driving various rhythm tone generators so as to be fed to the rhythm tone generator circuit 26 through a gate circuit 28 and the OR-circuit 24 when the gate circuit 28 is controlled to be on. The OR-circuit 24 is to OR-operate the respective ones of the corresponding tone generator driving signals in the normal pattern signal NPT and in the fill-in pattern signal FPT and deliver the driving signal for each rhythm tone generator, and particularly with respect to the cymbal tone generator, the OR-circuit 24 is to OR-operate the cymbal tone generator driving signal in the normal pattern signal NPT, the cymbal tone generator driving signal in the fill-in pattern signal FPT and a later described cymbal tone generator driving signal SYM and deliver the driving signal for the cymbal tone generator. The rhythm tone generator circuit 26 includes such various rhythm tone generators as are exemplified above and is to generate rhythm tone signals RHY by driving these rhythm tone generators in response to the corresponding tone generator driving signals from the OR-circuit 24. The rhythm tone signals RHY will be fed to a sound system 32 through a gate circuit 30 when the gate circuit 30 is controlled to be on, and will be converted to rhythm tone sounds by a speaker or the like through a power amplifier or the like.

In a rhythm control switch B, a fill-in switch FIL consists of a push-on type switch so that the state signal "0" or "1" corresponding respectively to the off- or on-state will be fed to a T-flip-flop 34 for fill-in control and to an inverter 36. The flip-flop 34 is to be reset by the output signal of an AND-gate 38 to which the output signal of the inverter 36 and the measure end pulse ME is inputted. The output Q (non-inverted side) of the flip-flop 34 will be fed as a controlling input to the gate circuit 28 directly and will be fed as a controlling input to the gate circuit 22 through an inverter 40 and and an OR-gate 42. In the rhythm control switch B, a break switch BRK consists of a push-on type switch so that the state signal "0" or "1" corresponding respectively to the off- or on- state will be fed to a T-flip-flop 44 for break control and to an inverter 46. The flip-flop 44 is to be reset by the output signal of an AND-gate 48 to which the output signal of the inverter 46 and the measure end pulse ME is inputted. The output $\overline{Q}$ (inverted side) of the flip-flop 44 will be fed as a controlling input to the gate circuit 30. Both flip-flops 34 and 44 will be initially reset when power is switched on. After the power is switched on, if neither of the fill-in switch FIL and the break switch BRK is pushed on, the output Q of the flip-flop 34 will continue to be at the "0" state and the output $\overline{Q}$ of the flip-flop 44 will continue to be at the "1" state. Therefore, the gate 22 will continue to take the on-state in response to the signal "1" obtained by inverting the output Q="0" of the flip-flop 34 via the inverter 40, and the gate circuit 30 will continue to take the on-state in response to the output $\overline{Q}$="1" of the flip-flop 44.

A controlling circuit section is formed of the elements enclosed with the chain line C in FIG. 1.

In such state, if the above described rhythm start switch ST is turned on, the normal pattern signals NPT will be fed to the rhythm tone generator circuit 26 through the gate circuit 22 and the OR-circuit 24, and the rhythm tone generator circuit 26 will generate the rhythm tone signals RHY in response to the normal pattern signals NPT. These rhythm tone signals RHY will be fed to the sound system 32 through the gate circuit 30. Therefore, rhythm tone sounds will be generated according to the normal pattern of the selected particular type of rhythm (for example, a waltz) from the sound system 32 and an ordinary rhythm performance will be made.

While the rhythm tone sounds are being generated according to the normal pattern as mentioned above, if the fill-in switch FIL is pushed on, the controlling operation for the fill-in mode will be carried out. This fill-in mode controlling operation exhibit different manners as the timewise actuation modes are different. As largely divided, there are three manners as exemplified in FIG. 2 [I] to [III].

Figure 2:
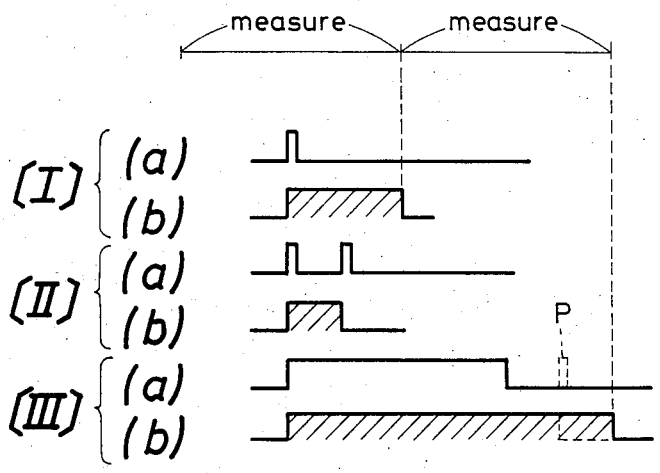
FIG. 2 is a time chart for explaining the operation in the embodiment of FIG. 1.

FIG. 2 [I] shows the operation in case the fill-in switch FIL is pushed on once (only momentarily) in the course of one measure. As the flip-flop 34 is triggered in response to such fill-in switching-on signal as is shown in (a), the output signal of the inverter 40 will become "0" in response to the output Q="1" of the flip-flop 34. Here, in the fill-in variation selecting switch circuit 18, if the second or fourth fill-in variation is selected, as the output signal of an OR-gate 50 inputted with a fill-in variation designating signal VS1 which designates the first fill-in variation and a fill-in variaiton designating signal VS3 which designates the third fill-in variation as inputs is "0", the gate circuit 22 will become off in response to the output signal "0" of the inverter 40. At the same time, the gate circuit 28 will become on in response to the output Q="1" of the flip-flop 34. Thereafter, at the end of the measure in which the fill-in switch was pushed on, the read-out control circuit 20 generates a measure end pulse ME, and thus the flip-flop 34 will be reset by this pulse. As a result, the output Q of the flip-flop 34 will be at the "1" state in the hatched period in FIG. 2 [1] (b). Then, if the flip-flop 34 is reset, the gate circuit 22 will become on and the gate circuit 28 will become off. Therefore, when the second or fourth fill-in variation has been selected, in the period of the output Q="1" of the flip-flop 34, the rhythm pattern will be switched from the normal pattern to the fill-in pattern, and the fill-in rhythm will be performed alone. Then, when the period of the output Q="1" of the flip-flop ends, the rhythm pattern returns to the normal pattern, and the normal pattern rhythm performance will be resumed. As different from the above description, in the fill-in variation selecting switch circuit 18, when the first or third fill-in variation has been selected, the fill-in variation designating signal VS1 or VS3 will be "1" and this signal "1" will make the gate circuit 22 on through the OR-gate 50 and 42. Therefore, in the period of the output Q="1" of the flip-flop 34, both gate circuits 22 and 28 will be on and the rhythm tone signals will be generated according to both of the normal pattern and the fill-in pattern. Such rhythm tone signal generation is called a superimposed beating of rhythms and is effective to obtain a composite (combined) fill-in rhythm different from a mere fill-in rhythm by the combined effect of the rhythm of the normal pattern and the rhythm of the fill-in pattern.

FIG. 2 [II] shows the operation in case the fill-in switch FIL is pushed on twice within one measure. The flip-flop 34 will be triggered by the first fill-in switching-on signal shown in (a) and then will be reset by the next fill-in switching-on signal. Therefore, the output Q of the flip-flop 34 will be at the "1" state in the hatched period in FIG. 2 [II] (b). In this period, the fill-in rhythm alone or the superimposed rhythm will be performed and then will return to the normal rhythm performance the same as in the case of the above described FIG. 2 [I].

FIG. 2 [III] shows the operation in the case that the fill-in switch FIL is pushed on within a measure and is held on to the middle of the next measure. The flip-flop 34 is triggered by the rise of the fill-in switching-on signal shown in (a) and is kept on until it is reset by the measure end pulse ME at the end of the next measure in which the fill-in switch FIL is released. Therefore, the output Q of the flip-flop 34 will be at the "1" state in the hatched period in FIG. 2 [III] (b). In this period, the fill-in rhythm alone or the superimposed rhythm will be performed and then will return to the normal rhythm performance the same as in the case of the above described FIG. 2 [I]. By the way, in the case of FIG. 2 [III], after the on-state of the fill-in switch FIL is discontinued, if the fill-in switch FIL is pushed on once again within the measure as shown by the broken line P, the flip-flop 34 will be reset at this on-time point and its output Q will become "0" as shown by the broken line in (b). Therefore, in this case before the end of the measure, the performance of the fill-in rhythm or the superimposed rhythm will end at the time point when the fill-in switching-on signal is generated and the normal rhythm performance will be resumed.

As exemplified on FIG. 2 [I] to [III], if the fill-in controlling manners are made different as the timewise actuation modes of the fill-in switch FIL are different, a complicated fill-in control can be made with one fill-in switch, the intention of the user will be easily reflected on the automatic rhythm performance and various rhythm performances will be possible.

In the above mentioned fill-in mode controlling operation, when the fourth fill-in variation has been selected with the fill-in variation selecting switch circuit 18 in advance, only in case the fill-in rhythm ends at the end of the measure, a cymbal tone signal will be generated as synchronized with the top beat of the next measure. In order to control the generation of the cymbal tone signal, there are provided an AND-gate 52, R - S flip-flop 54 for a cymbal flag and AND-gate 56. The AND-gate 52 is inputted with the fill-in variation designating signal VS4 which designates the fourth fill-in variation, the output Q of the flip-flop 34 and the measure end pulse ME. When the fourth fill-in variation is selected and the output Q of the flip-flop 34 is "1", if the measure end pulse ME comes at the end of the measure, the output signal of the AND-gate 52 will become "1" to set the flip-flop 54. When the flip-flop 54 is set, its output Q="1" will be fed to the AND gate 56. At this time, as the flip-flop 34 has been reset by the measure end pulse ME, the output signal of the inverter 40 will be "1" and will be also fed to the AND-gate 56. After the measure end pulse ME is generated, if the first top beat pulse BP is generated, this top beat pulse BP will be fed to the OR-circuit 24 as a cymbal tone generator driving signal SYM through the AND-gate 56. The flip-flop 54 will be reset by the fall of the top beat pulse BP. Therefore, from the sound system 32, after the fill-in rhythm ends at the end of a measure, a cymbal tone sound will be generated as synchronized with the top beat of the next measure. The generation of such cymbal tone sound will be effective to invite the attention of the audience, make it easy to follow the rhythm and make the rhythm more variable, when the rhythm pattern is switched from the fill-in pattern to the normal pattern.

While the rhythm performance is progressing as in the above, if the break switch BRK is pushed on, the rhythm break (rhythm interruption) controlling operation will be carried out. This rhythm break controlling operation will take different manners as the timewise actuation mode of the break switch BRK is different. As largely divided, there are the same three manners as are shown in FIG. 2 [I] to [III]. That is to say, when the break switch BRK is actuated as shown in FIG. 2 [I] (a), the output $\overline{Q}$ of the flip-flop 44 will become "0" in the hatched period in FIG. 2 [I] (b), when the break switch BRK is actuated as shown in FIG. 2 [II] (a), the output $\overline{Q}$ of the flip-flop 44 will become "0" in the hatched period in FIG. 2 [II] (b) and, when the break switch BRK is actuated as in FIG. 2 [III] (a), the output $\overline{Q}$ of the flip-flop 44 will become "0" in the hatched period in FIG. 2 [III] (b). By that the gate circuit 30 is controlled to be off in response to the output $\overline{Q}$="0" of the flip-flop 44, the rhythm break will be able to be controlled in such different switch actuation modes as in FIG. 2 [I] (a), [II] (a) and [III] (a).

Although the above mentioned embodiment is shown as a hardware construction, the present invention also can be embodied by using microcomputers or the like with a software.

What is claimed is:

1. An automatic rhythm performing apparatus comprising:

a rhythm pattern generator for repetitively generating (i) a repetition period signal defining a repetition period, (ii) a first rhythm pattern signal representing kinds and timings for rhythm tones to constitute a first rhythm pattern with said period, and (iii) a second rhythm pattern signal representing kinds and timings for rhythm tones to constitute a second rhythm pattern with said period;

a rhythm tone generator for generating rhythm tone signals of said kinds and timings in response to said first and second rhythm pattern signals;

a rhythm control switch; and control means connected to said rhythm pattern generator, said rhythm tone generator and said rhythm control switch for variably controlling the generation and duration of said rhythm tone signals according to the differences in actuation timings of said rhythm control switch with respect to said repetition period.

2. An automatic rhythm performing apparatus according to claim 1 wherein said control means controls the generation of said rhythm tone signals so that said rhythm tone signals correspond to said first rhythm pattern signal in a normal state and to said second rhythm pattern signal in a temporary state according to the actuation of said rhythm control switch.

3. An automatic rhythm performing apparatus according to claim 1 wherein said control means controls in two different manners so that said temporary state is maintained until the end of said period in which the actuation of said rhythm control switch is released in a first manner whereas said temporary state is maintained until a further actuation of said rhythm control switch is carried out within said period in which the actuation of said rhythm control switch is released in a second manner.

4. An automatic rhythm performing apparatus according to claim 2 wherein said control means controls the generation of said rhythm tone signals so that said rhythm tone signals correspond to said first rhythm pattern signal in a normal state and to said first and second rhythm pattern signals in a temporary state according to the actuation of said rhythm control switch.

5. An automatic rhythm performing apparatus according to claim 2 wherein said control means so controls that a rhythm tone signal of a particular kind is generated at a moment subsequent to a period where said rhythm tone signals correspond to the temporary rhythm pattern signals.

6. An automatic rhythm performing apparatus according to claim 1 wherein said repetition period corresponds to a measure.

7. An automatic rhythm performing apparatus according to claim 1 wherein said repetition period corresponds to a measure.

8. An automatic rhythm performing apparatus for use in an electronic musical instrument, comprising:

rhythm pattern generator means for repetitively generating a repetition period signal defining a repetition period, and a rhythm pattern signal within said period corresponding to a first rhythm pattern or a second rhythm pattern;

a rhythm control switch;

control means for changing the generated rhythm pattern signal as follows:

(i) if said rhythm control switch is activated during the generation of said first rhythm pattern, said generated rhythm pattern signal is changed from said first rhythm pattern to said second rhythm pattern and said second rhythm pattern is continuously generated while said rhythm control switch remains activated;

(ii) if said rhythm control switch is deactivated during the generation of said second rhythm pattern, said generated rhythm pattern signal is changed from said second rhythm pattern to said first rhythm pattern upon the occurrence of either the activation of said rhythm control switch or the end of said repetition period.

* * * * *